US006397829B1

(12) United States Patent
Toyoda

(10) Patent No.: US 6,397,829 B1
(45) Date of Patent: Jun. 4, 2002

(54) PURGE CONTROL SYSTEM OF ENGINE

(75) Inventor: Katsuhiko Toyoda, Shizuoka-ken (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/650,056

(22) Filed: Aug. 29, 2000

(30) Foreign Application Priority Data

Aug. 31, 1999 (JP) ..... 11-246466
Jun. 30, 2000 (JP) ..... 2000-198405

(51) Int. Cl.[7] ..... F02D 41/00

(52) U.S. Cl. ..... 123/674; 123/698

(58) Field of Search ..... 123/674, 698

(56) References Cited

U.S. PATENT DOCUMENTS 5,544,638 A * 8/1996 Yuda ..... 123/674
5,546,917 A * 8/1996 Onasai et al. ..... 123/698
5,623,914 A * 4/1997 Kawamoto et al. ..... 123/674
5,694,911 A * 12/1997 Kawamoto et al. ..... 123/674
6,173,703 B1 * 1/2001 Matsumoto ..... 123/674
6,230,699 B1 * 5/2001 Mitsutani ..... 123/698

FOREIGN PATENT DOCUMENTS

JP 11022565 1/1999

* cited by examiner

*Primary Examiner*—John Kwon
(74) *Attorney, Agent, or Firm*—Morrison Law Firm

(57) ABSTRACT

A purge control system of an engine has a purge valve which is opened and closed in accordance with the state of operation of the engine so as to establish a purge-on mode and a purge-off mode, thereby controlling purge rate which is the flow rate of the purge gas supplied to said engine. An air-fuel ratio feedback controller performs feedback control of the air-fuel ratio based on an output signal from an air-fuel ratio sensor and a purge density which is computed as the concentration of the evaporated fuel in the purge gas supplied to said engine. An air-fuel ratio correcting device performs, in the purge-on mode, a purge learning control having a plurality of cycles for learning the results of computations of the purge density and for effecting correction of the air-fuel ratio based on purge learned values obtained through the learning. The air-fuel ratio correcting device effects, in the purge-off mode, correction of the air-fuel ratio based on normal learned values learned in the purge-off mode. The system further has a control unit for setting the number of the purge learning cycles and the number of the normal learning cycles, so as to vary the frequency of the purge learning cycles, based on the state of the computed purge density.

9 Claims, 12 Drawing Sheets

PURGE CONTROL SYSTEM OF ENGINE

BACKGROUND OF THE INVENTION

1. Field of the Invention

The present invention relates to a purge control system of an engine and, more particularly, to a purge control system which performs both an air-fuel ratio control and a learning purge control.

2. Description of the Related Art

A vehicle engine having a purge control system is known. Such a purge control system includes a canister which is connected between an evaporated fuel passage communicating with the interior of a fuel tank and a purge passage communicating with an intake system of the engine. Fuel in gaseous phase evaporated in the fuel tank is introduced to and sorbed (taken up and held either by absorption or adsorption) by the canister. The sorbed fuel is purged from the canister by fresh air introduced through the intake system. The purged gaseous fuel is then supplied to the engine along with the intake air. The purge control system further includes a purge valve which is disposed in the purge passage. The purge valve is turned on and off in accordance with the state of operation of the engine so as to control the rate of flow of the purge gas sucked into the engine.

The flow rate of the purge gas supplied to the engine is referred to as "purge rate". The control of the purge rate is referred to as "purge control" in the following description. A feedback control is performed to optimize the air-fuel ratio, based on an output signal from an air-fuel ratio sensor provided in the exhaust system of the engine and on a purge gas concentration which is a computed value indicative of the concentration of the evaporation fuel in the purge gas supplied to the engine. This concentration of the fuel in the purge gas is referred to as a "purge density". In a "purge-on" mode which allows the supply of the purge gas into the engine, the air-fuel ratio is controlled while being corrected with a purge-mode learned value which is obtained through a learning computation of the purge density. In contrast, in a "purge-off" state which does not allow the supply of the purge gas to the engine, the air-fuel ratio is controlled while being corrected with a normally-learned value. The purge rate is controlled by the purge valve, so as to conform with a value read from a map which has been two-dimensionally formulated on two factors of engine operation: namely, engine speed and the load on the engine, and which is stored in a control means, e.g., an ECU (Electronic Control Unit).

This type of purge control system for engine is disclosed, for example, in Japanese Unexamined Patent Application Publication No. 11-22565. In this known purge control system, a purge correction value is computed based on the purge density and the purge rate that were employed in the preceding cycle of control. Correction of the air-fuel ratio is effected using this purge correction value, in synchronization with the purge-on operation.

This known purge control system has the following disadvantages. Firstly, it is to be pointed out that this purge control system cannot stably control the purge density when the engine is operating under a light load. Fluctuation in the purge density causes a fluctuation in the air-fuel ratio of the mixture, resulting in an increase in the exhaust emissions and deterioration in the drivability. In addition, purge density is affected by a change in the air-fuel ratio that takes place when the engine is accelerated and decelerated. This serves to render the air-fuel ratio unstable, resulting in increased exhaust emissions.

Before the engine is started, evaporated fuel may stagnate in the evaporated fuel passage pipe between the full tank and the canister, even though only a small amount of fuel has been sorbed by the canister. If the engine is started with a small intake air flow rate and a small purge rate, the stagnant evaporated fuel is sucked into the engine. Consequently, a computation result indicates that the purge density is too high, and the purge rate is determined on an assumption that the purge gas is too rich. A subsequent air-fuel control, in particular under a large flow rate of the intake air, tends to make the mixture leaner, in order to compensate for the effect produced by the too rich purge gas. In this state, however, only a small amount of evaporated fuel resides in the canister and the evaporated fuel passage pipe. This small amount of evaporated fuel is rapidly depleted. Consequently, the air-fuel ratio is wrongly controlled to form an excessively lean mixture, leading to inferior drivability and increased exhaust emissions.

Another problem encountered with the use of this known purge control system is as follows. The purge control is performed by adjusting the purge rate based on the purge density. Purge rate cannot be definitely determined in a range of engine operation where the air-fuel ration feedback control and the purge learning control for computing the purge density are not performed. The feedback control is suspended during heavy-load, high-speed running of the engine with an enriched mixture, and so is the purge control.

Much evaporated fuel is accumulated in the fuel tank during long heavy-load operation of the engine as in the case of running along an ascending slope. This problem is notable particularly at high altitude where the engine power is reduced to require a greater throttle opening by pressing down on the accelerator pedal to a greater degree. Thus, driving at high altitude generally requires the engine to operate with enriched mixture for a long time. This causes a high pressure to be established in the fuel tank because purging is suspended during such long heavy-load operation of the engine, and poses a risk of escape of the evaporated fuel through a vent hole of the canister. A rapid rise in the fuel tank internal pressure may wrongly lead to warning that a fuel tank internal pressure sensor is malfunctioning, even when the sensor is operating safely.

OBJECTS AND SUMMARY OF THE INVENTION

Accordingly, an object of the present invention is to provide a purge control system of an engine which overcomes the above-described problems of the prior art.

To this end, according to the present invention, there is provided a purge control system of an engine, comprising: a canister between an evaporated fuel passage leading from the interior of a fuel tank and a purge passage leading to an intake system of the engine, for sorbing and holding evaporated fuel coming from the fuel tank and for allowing the evaporated fuel to be purged therefrom by introduction of air, so that the air and the evaporated fuel in combination forming a purge gas to be supplied to the engine; a purge valve disposed in the purge passage and opened and closed in accordance with the state of operation of the engine so as to establish a purge-on mode and a purge-off mode, thereby controlling purge rate which is the flow rate of the purge gas supplied to the engine; an air-fuel ratio sensor disposed in an exhaust system of the engine; an air-fuel ratio feedback controller for performing a feedback control of the air-fuel ratio based on an output signal from the air-fuel ratio sensor and a purge density which is computed as the concentration of the evaporated fuel in the purge gas supplied to the engine; air-fuel ratio correcting means for performing, in the purge-on mode, a purge learning control having a plurality of cycles for learning the results of computations of the purge density and for effecting correction of the air-fuel ratio based on purge learned values obtained through the learning, the air-fuel ratio correction means performing, in the purge-off mode, a normal learning control having a plurality of normal learning cycles to obtain normal learned values and effecting correction of the air-fuel ratio based on normal learned values; and controlling means for setting the number of the purge learning cycles and the number of the normal learning cycles, so as to vary the frequency of the purge learning cycles, based on the state of the computed purge density.

The controlling means may fix the number of the purge learning cycles to a predetermined value only in the first period of purge learning control which immediately follows start-up of the engine, and learn the results of the purge density computations until the total number of the purge learning cycles reaches the predetermined value.

The controlling means also may set, based on the purge density, a purge ratio which is the ratio of the purge rate to the flow rate of the intake air introduced into the engine.

The arrangement may be such that the controlling means determines, during light-load operation of the engine, a purge density correction coefficient based on the level of the load on the engine, and effects a correction of the computed purge density by using the purge density correction coefficient.

Alternatively, the arrangement may be such that the controlling means determines, when the level of the load on the engine is being changed, a purge density correction coefficient based on the amount of the change in the level of the load on the engine, and effects a correction of the computed purge density by using the purge density correction coefficient.

When the purge density correction coefficient is used, the controlling means may effect the correction of the computed purge density by using the purge density correction coefficient only in the first period of purge learning control which immediately follows start-up of the engine.

Preferably, the arrangement may be such that, when the amount of change in the purge density is greater than a purge density variation reference value while the amount of change in the purge ratio is greater than a purge ratio variation reference value, the controlling means increases the purge ratio to a target purge ratio progressively in a plurality of steps with a constant increment, whereas, when the amount of change in the purge density is smaller than the purge density variation reference value while the amount of change in the purge ratio is smaller than the purge ratio variation reference value, the controlling means controls the purge valve to open so as to increase the purge ratio to the target purge ratio in a non-stepped manner.

The arrangement also may be such that, when the feedback control of the air-fuel ratio has been suspended with the air-fuel mixture held in an enriched region, the controlling means performs the purge control by opening the purge valve, so as to achieve a constant purge ratio, a purge ratio determined based on the engine speed and the level of the load on the engine, or a purge ratio determined based only on the level of the load on the engine.

The arrangement also may be such that, when an idle switch is turned on and/or when the air-fuel ratio feedback control is suspended with the air-fuel ratio falling out of the enriched region, the controlling means performs the purge control by opening the purge valve, so as to achieve a constant purge ratio, a purge ratio determined based on the engine speed and the level of the load on the engine, or a purge ratio determined based only on the level of the load on the engine.

In accordance with the present invention having the features set forth above, the purge learned value and the normal learned value which are to be used in the correction control of the air-fuel ratio are acquired through repetition of purge learning cycles and normal learning cycles. The number of the purge learning cycles and the normal learning cycles are determined based on the purge density which is obtained through a computation. Thus, the frequency of the purge learning cycles varies in accordance with a change in the computed value of the purge density. For instance, when a large quantity of evaporated fuel remains sorbed in the canister, the purge rate, i.e., the flow rate of the purge gas, is increased, with the result that the purge density also is changed significantly. In such a case, the number or frequency of the purge learning cycles is increased so as to enable high resolution of the purge density computation. The air-fuel ratio is controlled based on the purge density that has been determined with the high resolution, whereby the rate of discharge of the exhaust emissions is stabilized. Stability of control of the exhaust emissions is impaired also by a too high density of the purge gas. In such a case, the purge control system of the invention also serves to lower the purge rate.

The above and other objects, features, and advantages of the present invention will become clear from the following description when the same is read in conjunction with the accompanying drawings.

DETAILED DESCRIPTION OF THE PREFERRED EMBODIMENTS

Figure 17:
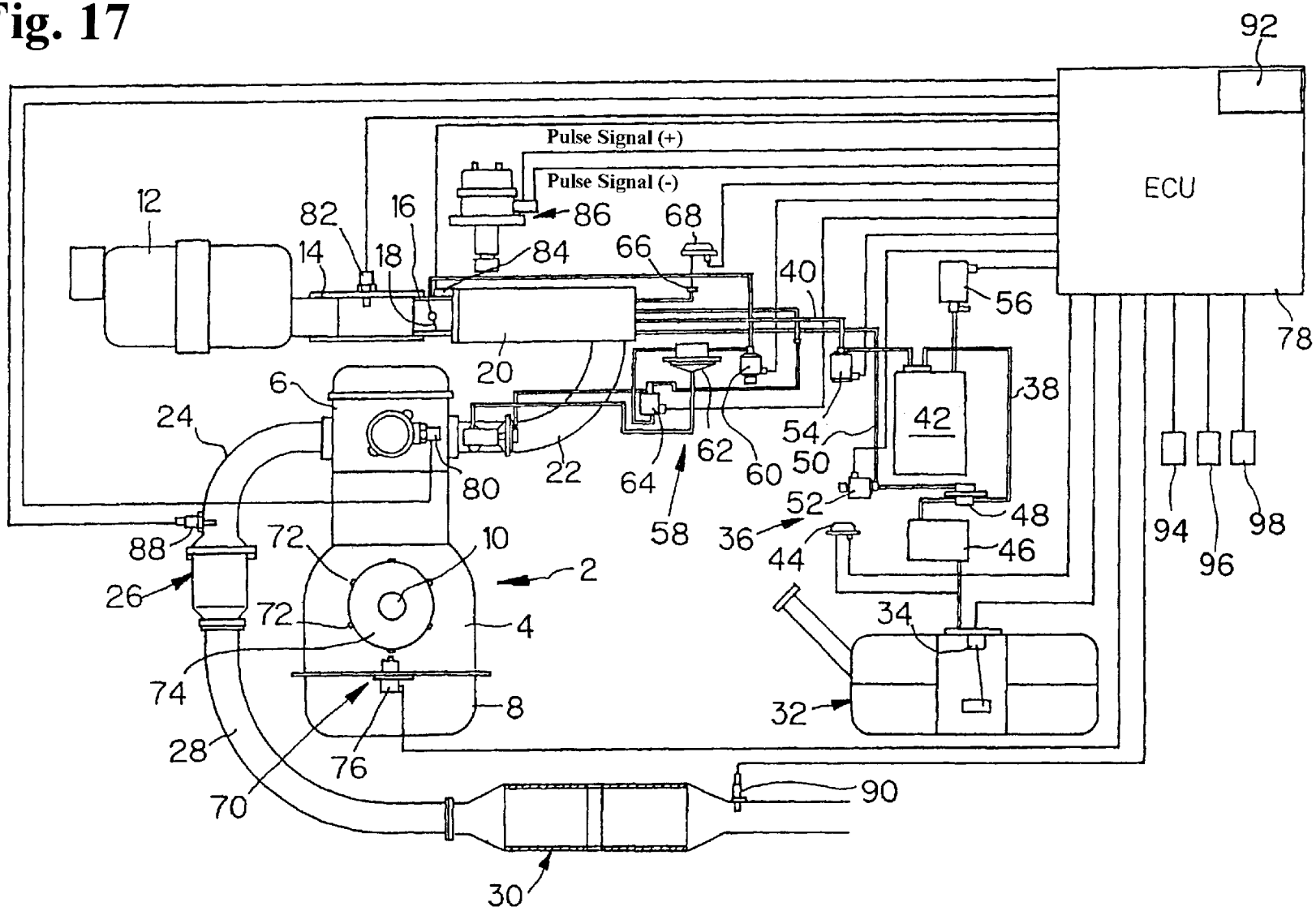
FIG. 17 is an illustration of a purge control system.

Referring first to FIG. 17, an engine 2, mounted on a vehicle (not shown), has a cylinder block 4, a cylinder head 6, an oil pan 8, a crankshaft 10, an air cleaner 12, an intake pipe 14, a throttle body 16, a throttle valve 18, a surge tank 20, an intake manifold 22, an exhaust manifold 24, a front catalyst converter 26, an exhaust pipe 28, a rear catalyst converter 30, and a fuel tank 32. A fuel level gauge 34 in the fuel tank 32 detects the level of the fuel in the fuel tank 32 and produces a voltage corresponding to the fuel level.

An evaporated fuel control device 36 is provided between the surge tank 20 and the fuel tank 32. The evaporated fuel control device 36 includes a canister 42 connected between an evaporated fuel passage 38 which leads from the fuel tank 32 and a purge passage 40 which leads to the surge tank 20 of the intake system of the engine 2. The canister 42 sorbs and holds evaporated fuel introduced from the fuel tank 32. The canister 42 is supplied with fresh air which serves to purge and carry the sorbed fuel, so that the evaporated fuel is supplied to the engine 2 along with the air. The evaporated fuel control device 36 has a fuel tank internal pressure sensor 44, a separator 46 and a pressure control valve 48 which are arranged in this order starting from a portion of the evaporated fuel passage 38 near the upstream end adjacent to the fuel tank 32. The pressure control valve 48 communicates with the surge tank 20 via a pressure passage 50. The pressure passage 50 is provided with a vacuum control valve 52. The purge passage 40 is provided with a purge valve 54 which is duty-controlled so as to be turned on and off to create the purge-on mode and the purge-off mode so as to perform a purge control, i.e., to control the purge rate which is defined as the flow rate of the purge gas supplied to the engine 2, in accordance with the state of operation of the engine 2. The canister 42 is equipped with an air vent control valve 56.

The intake system of the engine has an EGR (exhaust gas recirculating) device 58 which recirculates part of the exhaust gas to the intake system of the engine. The EGR device 58 includes an EGR control valve 60, a back pressure control valve 62, and an EGR decision valve 64.

The surge tank 20 is provided with a pressure sensor 68 which senses the intake pipe pressure through a filter 66.

The engine 2 is equipped with a crank angle sensor 70 which also serves as an engine speed sensor. The crank angle sensor 70 is provided with a crank angle plate 74 fixed to the crankshaft 10. Crank angle plate 74 includes a plurality of teeth 72 on its outer peripheral edge. An electromagnetic pickup 76 attached to the cylinder block 4 senses the passage of teethe 72 as the crankshaft rotates past it.

The crank angle sensor 70 is connected to a control unit (ECU) 78 which constitutes controlling means as an element of the purge control system in accordance with the present invention.

The following sensors and components are connected to the control unit 78: a water temperature sensor 80 attached to the cylinder head 6, an intake air sensor 82 attached to the intake pipe 14, a throttle opening sensor 84 attached to the throttle body 16, an igniter 86, the fuel level gauge 34, the pressure sensor 68, the tank internal-pressure sensor 44, a vacuum control valve 52, the air vent control valve 56, the purge valve 54, the EGR control valve 60, the EGR decision valve 64, a front oxygen concentration sensor 88 which is attached to the exhaust manifold 24 and which serves as an air-fuel ration sensor, a rear oxygen concentration sensor 90 which is attached to an exhaust pipe 28 downstream of the rear catalyst converter 30 and which serves as another air-fuel ratio sensor, an atmospheric pressure sensor 92 for detecting the pressure of the atmosphere, a battery 94, an ignition key 96, and an idle switch 98.

The control unit 78 performs a feedback control to control the supply of the fuel as in a conventional engine control system. In addition, the control unit 78 performs a feedback control to optimize the air-fuel ratio based on the output signals from the oxygen concentration sensors 88 and 90 and also on the purge density which is computed as the concentration of the evaporated fuel in the purge gas supplied to the engine 2. More specifically, when a predetermined purge learning control condition is met, e.g., by a cooling water temperature of 75° C. or higher, the control unit 78 controls the purge valve so as to alternate between the purge-on mode and purge-off mode. To do this, the control unit 78 opens the purge valve 54 to establish the purge-on mode, and computes and learns the purge density (PDENC) at this moment. At the same time, the control unit 78 computes a purge learned value (KLERNC) and corrects the air-fuel ratio based on a purge correction value which is the computed purge learned value (KLERNC). The control unit 78 then closes the purge valve 54 to establish the purge-off mode, and computes a normal learned value (LLERNA) at this moment, and performs correction of the air-fuel ratio in accordance with a normal correction value which is the computed normal learned value (KLERNA). The manners in which these controls are performed is described later with reference to FIGS. 1 and 16.

Figure 12:
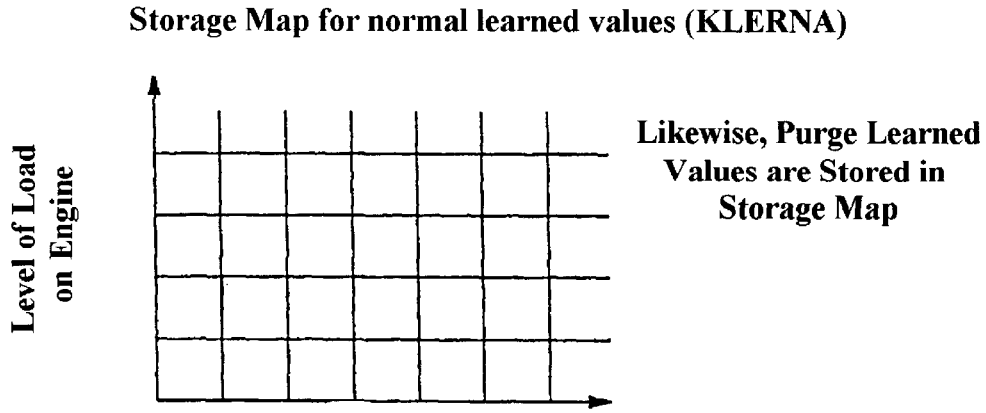
FIG. 12 is a map storing values of values normally learned based on the engine speed and the level of the load on the engine.

The normal learned values (KLERNA) thus computed are stored in the form of a map on which each normal learned value is readable in terms of two factors, namely: the engine speed and the level of the load imposed on the engine, as shown in FIG. 12. Although not shown, the purge learned value (KLERNC), that was computed in the immediately preceding learning cycle, is also stored in the map. Other previous purge learned values may not be stored.

Figure 8:
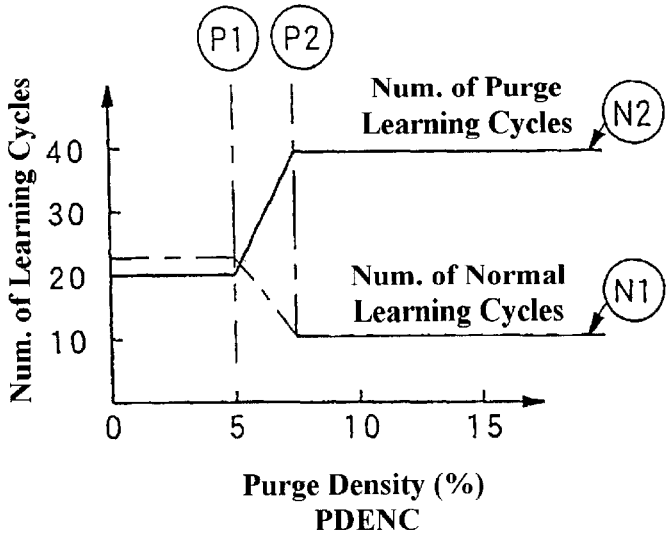
FIG. 8 is a diagram showing the manner in which the number of the learning cycles is determined based on the purge density.

Referring to FIG. 8, the control unit 78 sets the number of the purge learning cycles (solid line) and the number of the normal learning cycles (longshort dash line) based on the state of the computed purge density (PDENC), so as to vary the frequency of learning of the result of the computation of the purge density (PDENC), in accordance with a change in the computed purge density (PDENC). More specifically, as shown in FIG. 8, the number of the purge learning cycles is controlled such that, until the purge density (PDENC) reaches a value approximating a first predetermined value P1, the number of the normal learning cycles is slightly greater than the number of the purge learning cycles. When the purge density (PDENC) exceeds the first predetermined value P1, the number of normal learning cycles is progressively and gradually decreased until the purge density (PDENC) reaches a value near a second predetermined value P2. When the second predetermined value P2 is reached, the number of the normal learning cycles is set to a predetermined number N1. In the meantime, the number of the purge learning cycles starts to progressively and gradually increase when the purge density (PDENC) exceeds the first predetermined value P1. When the second predetermined value P2 is reached, the number of the purge learning cycles is set to a predetermined number N2.

As will be explained later with reference to FIGS. 3 and 16, the control unit 78 performs such a control that, after a start-up of the engine 2, the number of the purge learning cycles is set to a fixed number only for the first time of setting of the purge learning cycle number. More specifically, the purge valve is gradually opened with a constant rate of increase of valve opening, until a normal purge ratio (PQAMN) is reached. In the meantime, the results of computation of the purge density (PDENC) is continuously learned until the predetermined number of purge learning cycles, e.g., 40 cycles, is reached.

Further, as will be explained later with reference to FIG. 9, the control unit 78 sets the purge ratio (PQA) based on the purge density (PDEMC). The term purge ratio (PQA) is used herein to mean the ratio of the purge rate, i.e., the flow rate of the purge gas, to the intake air flow rate, i.e., the flow rate of the intake air supplied to the engine 2.

Further, as will be explained later with reference to FIG. 10, the control unit 78 also performs the following control. The computation of the purge density (PDENC) may be adversely affected by the feedback correction value (GAMASA) during light-load running of the engine 2. In order to eliminate such undesirable effect of the feedback correction value (GAMASA), the control unit 78 determines a purge density correction coefficient (xDEN) based on the level of the load on the engine which is measured in terms of, for example, intake air flow rate, throttle opening, and intake pipe suction vacuum, and corrects the computed purge density (PDENC) using the thus determined purge density correction coefficient (xDEN).

Further, as will be explained later with reference to FIG. 11, the control unit 78 also performs the following control. The computation of the purge density (PDENC) may be adversely affected by a variation in the feedback correction value (GAMASA) when the level of the load on the engine 2 is changed. In order to eliminate such undesirable effect of the variation in the feedback correction value (GAMASA), the control unit 78 determines a purge density correction coefficient (yDEN) based on the magnitude of the change in the level of the load on the engine, and corrects the computed purge density (PDENC) by using the thus determined purge density correction coefficient (yDEN).

Thus, the control unit 78 when computing the purge density (PDENC) may determine the purge density correction coefficient (xDEN) based on the level of the load on the engine or the purge density correction coefficient (yDEN) based on the magnitude of change in the level of the load on the engine, and may effect a correction of the computed purge density (PDENC) in accordance with the purge density correction value (xDEN or yDEN). Such a correction of the purge density may be executed only in the initial period of the purge learning, i.e., the first purge-on mode, as will be explained later in connection with FIG. 7.

The control unit 78 may be arranged such that, when the amount of change in the purge density (PDENC) is greater than a purge density variation reference value (PDLT) while the amount of change in the purge ratio (PQA) is greater than a purge ratio variation reference value (PQDLT), the controlling means increases the purge ratio to a target purge ratio (PQA) (see FIG. 9) progressively in a plurality of steps with a constant increment, whereas, when the amount of change in the purge density (PDENC) is smaller than the purge density variation reference value (PDLT) while the amount of change in the purge ratio (PQA) is smaller than the purge ratio variation reference value (PQDLT), the controlling means controls the purge valve 54 to open so as to increase the purge ratio (PQA) to the target purge ratio (PQA) (see FIG. 9) in a non-stepped manner.

Figure 13:
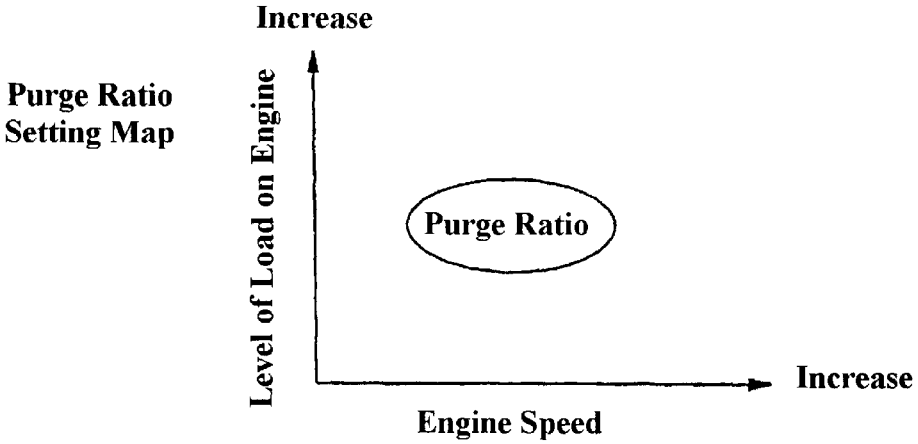
FIG. 13 is a diagram showing the manner in which the purge ratio is determined based on the engine speed and the level of the load on the engine.
Figure 14:
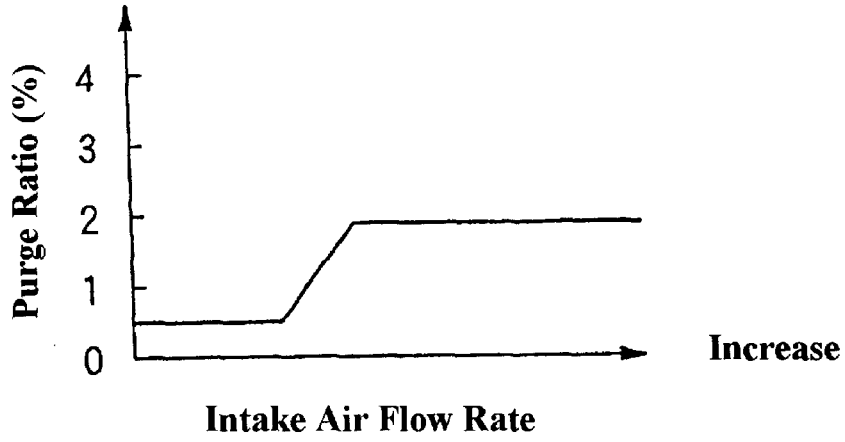
FIG. 14 is a diagram showing the manner in which the purge ratio is determined based on the intake air flow rate.
Figure 15:
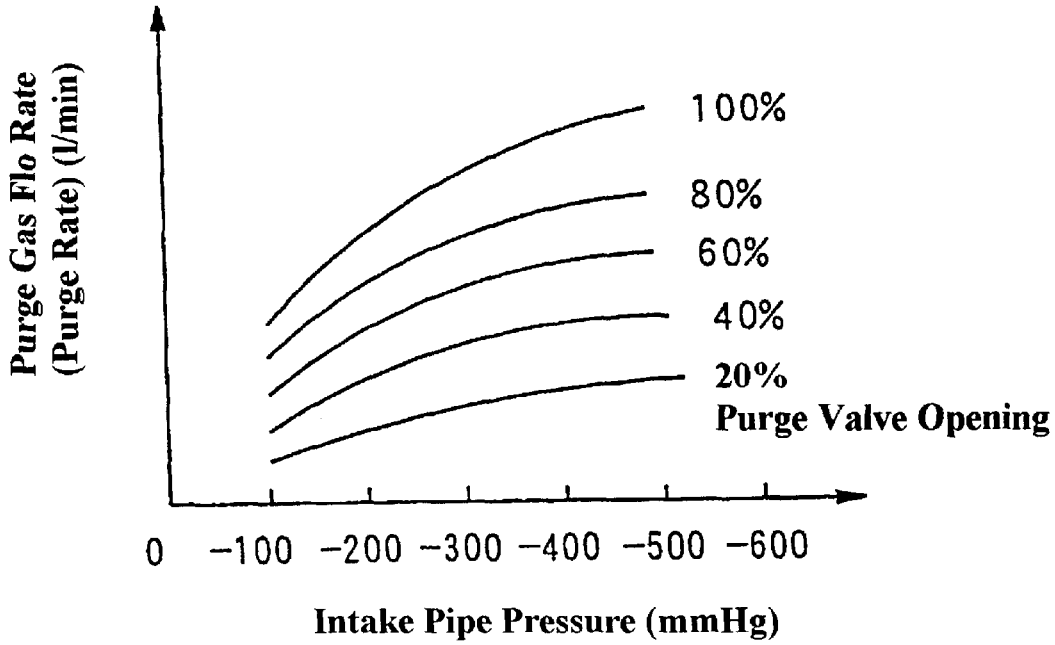
FIG. 15 is a diagram showing the manner in which the purge rate is determined based on the suction vacuum in the intake system.

The control unit 78 may be arranged such that, when the feedback control of the air-fuel ratio has been suspended with the air-fuel mixture held in an enriched region, the controlling means performs the purge control by opening the purge valve, so as to achieve a constant purge ratio, a purge ratio determined based on the engine speed and the level of the load on the engine (see FIG. 13), or a purge ratio determined based on the level of the load on the engine (see FIG. 14). To this end, the purge rates and the opening degrees (%) of the purge valve 54 are set in the control unit 78, in relation to the suction pressure in the intake pipe, for the enriched region of the air-fuel mixture (see FIG. 15).

Figure 5:
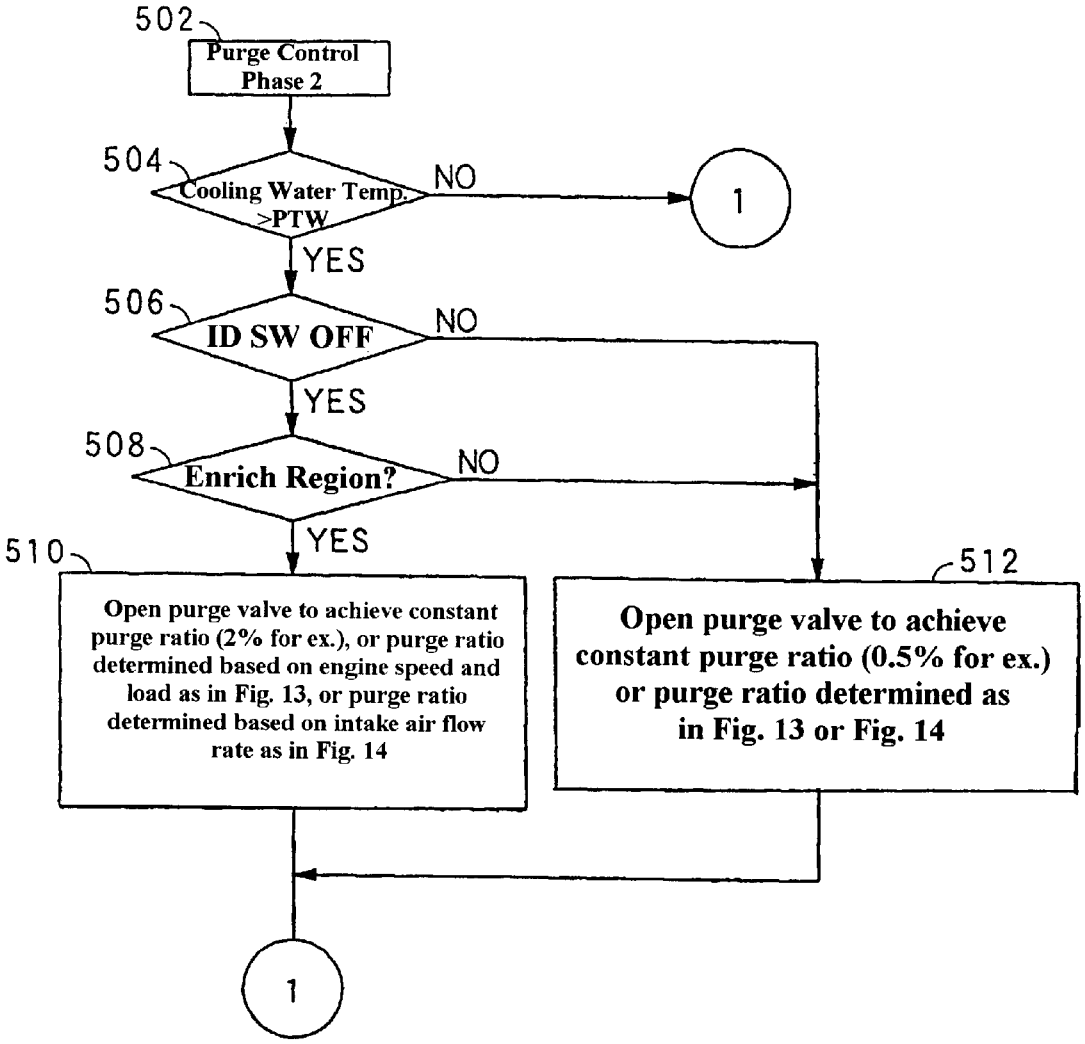
FIG. 5 is a flowchart showing Phase 2 of a purge control performed by the purge valve.

The control unit 78 also may be arranged such that, when an idle switch 98 has been turned on and/or when the air-fuel ratio feedback control has been suspended with the air-fuel ratio falling out of the enriched region, the controlling means performs the purge control by opening the purge valve 54, so as to achieve a constant purge ratio, a purge ratio determined based on the engine speed and the level of the load on the engine (see FIG. 13), or a purge ratio determined based on the level of the load on the engine (see FIG. 14), as will be seen from FIG. 5.

A description will now be given of the operation of this embodiment.

Figure 1:
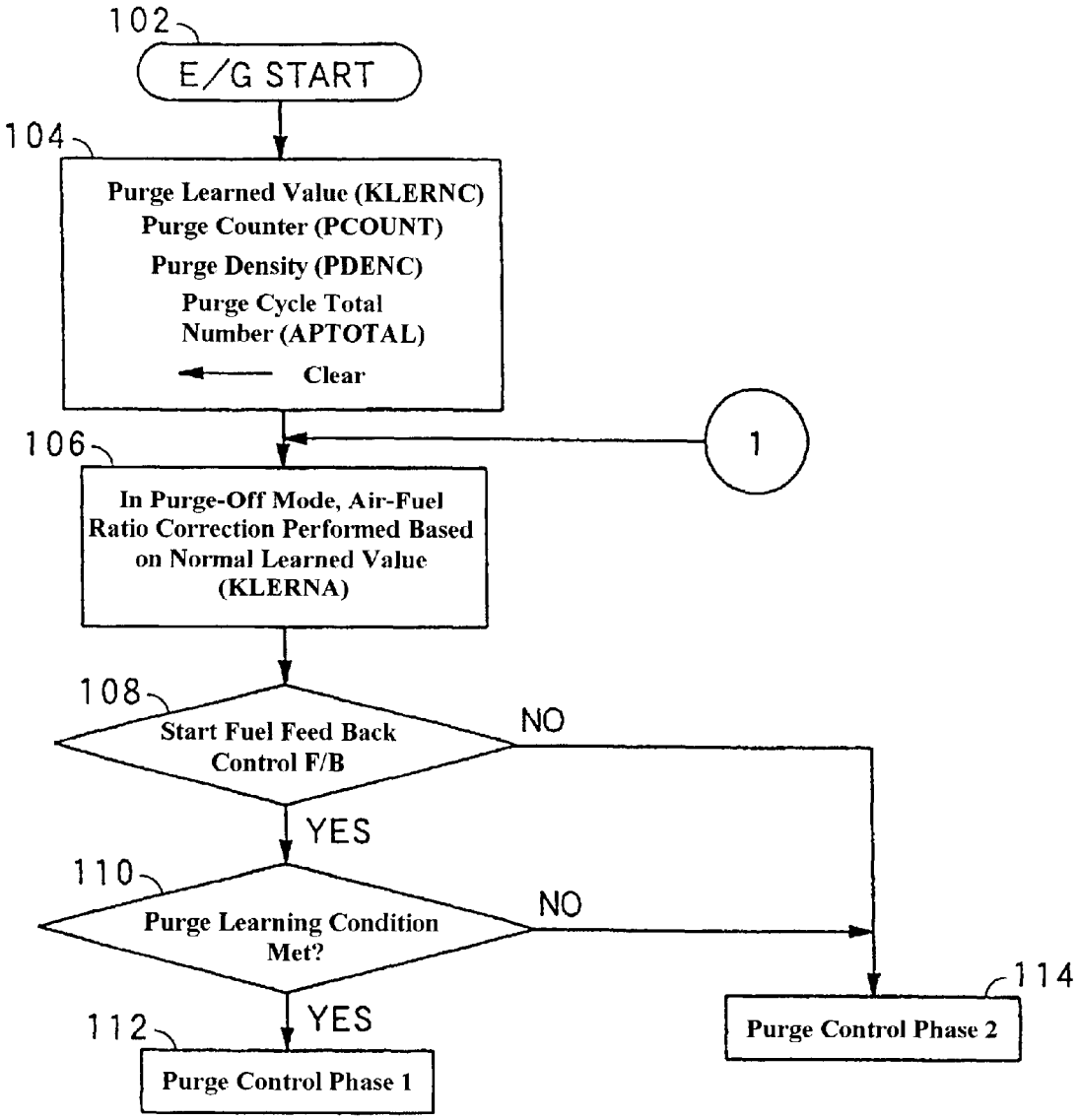
FIG. 1 is a flowchart showing a procedure in which a purge valve is controlled when an engine is started.

Referring first to FIG. 1, the program is started as the ignition key 96 is turned on to start up the engine 2 (Step 102). Upon starting of the program, the purge learned value (KLERNC), the content of a purge counter (PCOUNT), the purge density (PDENC) and the purge cycle total number (CPTOTAL) are respectively cleared and initialized (Step 104).

The rate ofpurge of the evaporated fuel from the canister 42 largely varies depending on the temperature of the canister 42. When the temperature of the canister 42 is high, the sorbed and held fuel is evaporated and delivered to the engine. In contrast, the rate of supply of the evaporated fuel from the canister 42 and the fuel tank 32 is smaller when the engine is still cold as in the period immediately after a start-up of a cold engine after a long halt of operation. Thus, the purge learned value (KLERNC) and the purge density (PDENC) that were obtained at the previous startup of the engine may not be adequate for use in the current start up of the engine. The purge learned value (KLERNC) and the purge density (PDENC) therefore have to be initialized and newly determined every time the engine is started. This is the reason why the initialization of values are effected in Step 104.

After the start-up of the engine 2, the purge-off mode is maintained or the purge control is performed at a limited low purge ratio, until the feedback fuel control and the purge learning control are commenced. Namely, in this period immediately after the start-up of the engine, the air-fuel ratio correction control is performed by busing the normal learned value (KLERNA) of the normal learned value storage map of FIG. 12 (Step 106).

Then, determination is conducted as to whether feedback control for the fuel supply has been commenced (Step 108).

When the answer to the question posed in Step 108 is "YES", a determination is conducted as to whether a predetermined purge learning control condition, e.g., the cooling water temperature being 75° C. or higher, has been satisfied (Step 110).

When the answer to the question in Step 110 is "YES", the first phase of the purge control (purge control phase 1 shown in FIG. 3) for the purge valve is executed (Step 112).

In contrast, a second phase of the purge control (purge control phase 2 shown in FIG. 5) is executed when the answer to the question in Step 108 is "NO" or when the answer to the question in Step 110 is "NO" (Step 114).

Figure 3:
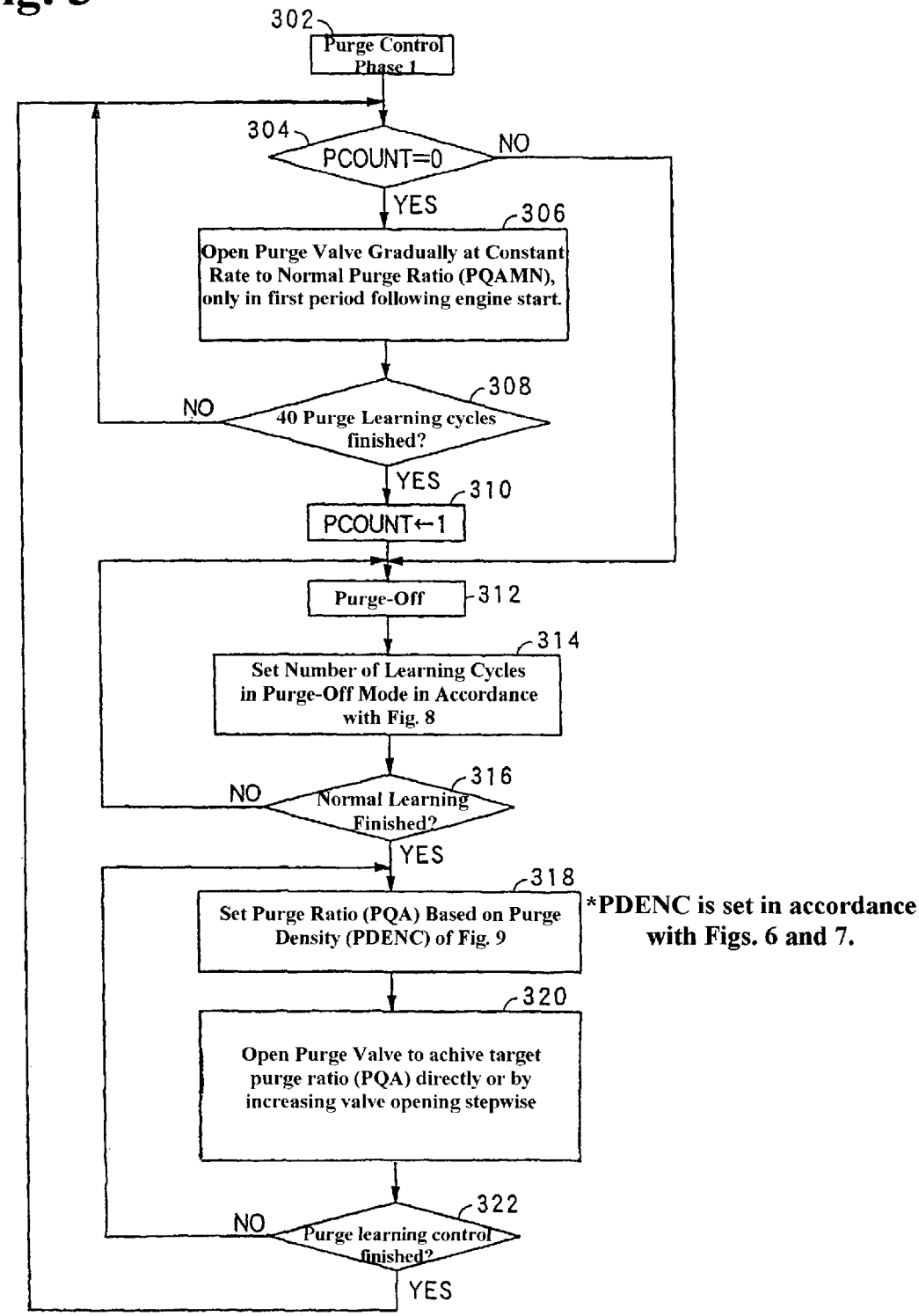
FIG. 3 is a flowchart showing Phase 1 of a purge control performed by a purge valve.

Referring to FIG. 3 showing the routine of the purge control phase 1 for controlling the purge valve, when the routine is started (Step 302), a determination is conducted as to whether the content of the purge counter (PCOUNT) is zero, i.e., whether the condition PCOUNT=0 is met (Step 304).

Figure 16:
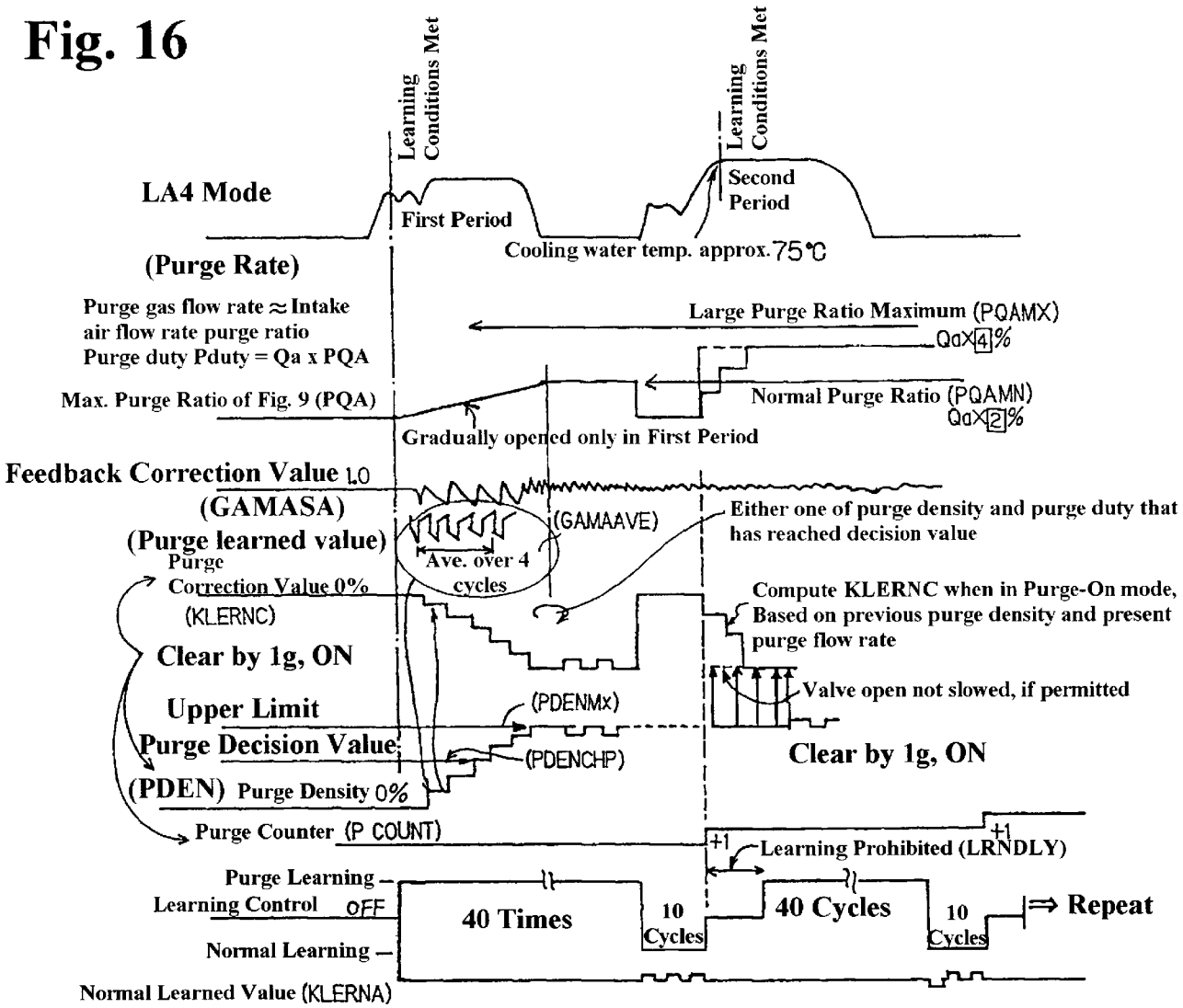
FIG. 16 is a time chart showing a purge control performed in accordance with an embodiment of the present invention.

If the answer to the question posed in Step 304 is "YES", as shown in FIG. 16, the purge valve 54 is gradually opened (Step 306) at a constant rate of increase of the valve opening until a normal purge ratio (PQAMN) is reached, such that a fixed number of purge learning cycles, e.g., 40 cycles, is performed in the beginning period after the start of the engine 2. This control is executed because the concentration of the fuel in the canister 42 and in the fuel pipe (not shown) are not known when the engine 2 is started.

Then, the question is whether the fixed number of the purge learning cycles, i.e., 40 cycles, has been completed (Step 308).

When the answer to the question posed in Step 308 is "NO", the routine returns to Step 304 which determines whether the content of the purge counter (PCOUNT) is PCOUNT=0.

When the answer to the question posed in Step 308 is "YES", the content of the purge counter (PCOUNT) is incremented by 1 (PCOUNT (1) (Step 310).

Then, the purge valve 54 is closed to create the purge-off mode (Step 312). When the purge valve 54 is kept closed, a normal learning process is executed to compute later-mentioned normal learned values.

When the answer to the question in Step 304 is "NO", the process directly skips to Step 312.

The duration of the purge-off mode is determined by the number of the normal learning cycles which in turn is set in accordance with the purge density (PDENC) that was computed in the immediately preceding cycle of computation, as shown in FIG. 8 (Step 314).

Then, determination is executed as to whether the predetermined number of normal learning cycles has been completed (Step 316).

If the answer to the question posed in Step 316 is "NO", the routine returns to Step 312 which keeps the purge valve 54 closed until the predetermined number of normal learning cycles is completed.

Figure 9:
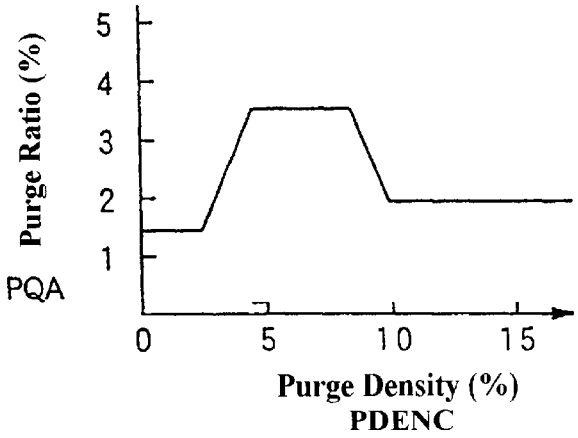
FIG. 9 is a diagram showing the manner in which the purge ratio is determined based on the purge density.

When the answer to the question posed in Step 316 is "YES", the purge ratio (PQA) is set in accordance with the diagram shown in FIG. 9, by giving a weight based on the purge density (PDENC) as obtained in the immediately preceding purge density computing cycle (Step 318). The purge density (PDENC) is set up by the first example (Embodiment 1) of the purge learning control shown in FIG. 6 or the second example (embodiment 2) of the purge learning control shown in FIG. 7, both of which will be described later.

Then, the purge valve 54 is opened while setting the purge ratio (PQA) to a target purge ratio (PQA). Alternatively, the purge ratio (PQA) is increased in a plurality of steps towards the target purge ratio (PQA), while increasing the opening of the purge valve 54 stepwise in accordance with the steps of increase of the purge ratio (PQA) (Step 320). When the purge valve 54 is opened, purge learning is conducted as will be described later, to compute the purge density and the purge learned value, as will be seen from FIG. 4.

Subsequently, a determination is conducted as to whether a predetermined number of purge learning cycles has been completed (Step 322).

When the answer to the question in Step 322 is "NO", the routine returns to Step 318.

When the answer to the question in Step 322 is "YES", the routine returns to Step 304.

Figure 4:
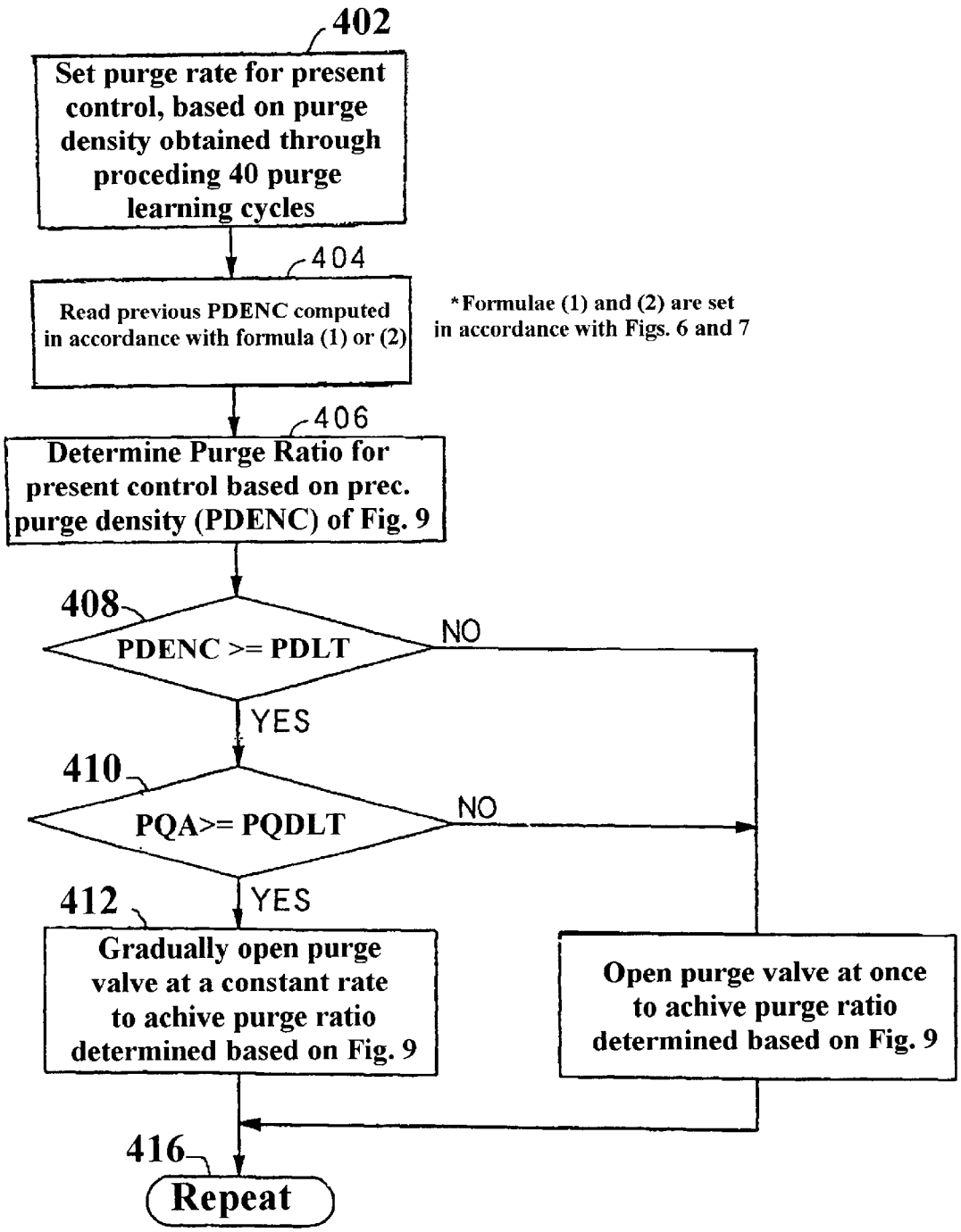
FIG. 4 is a flowchart showing a routine for setting a purge ratio based on a purge density.

The setting of the purge ratio (PQA) based on the purge density (PDENC) performed in Steps 318 and 320 (see FIG. 3) is conducted in accordance with the flow shown in FIG. 4.

Figure 6:
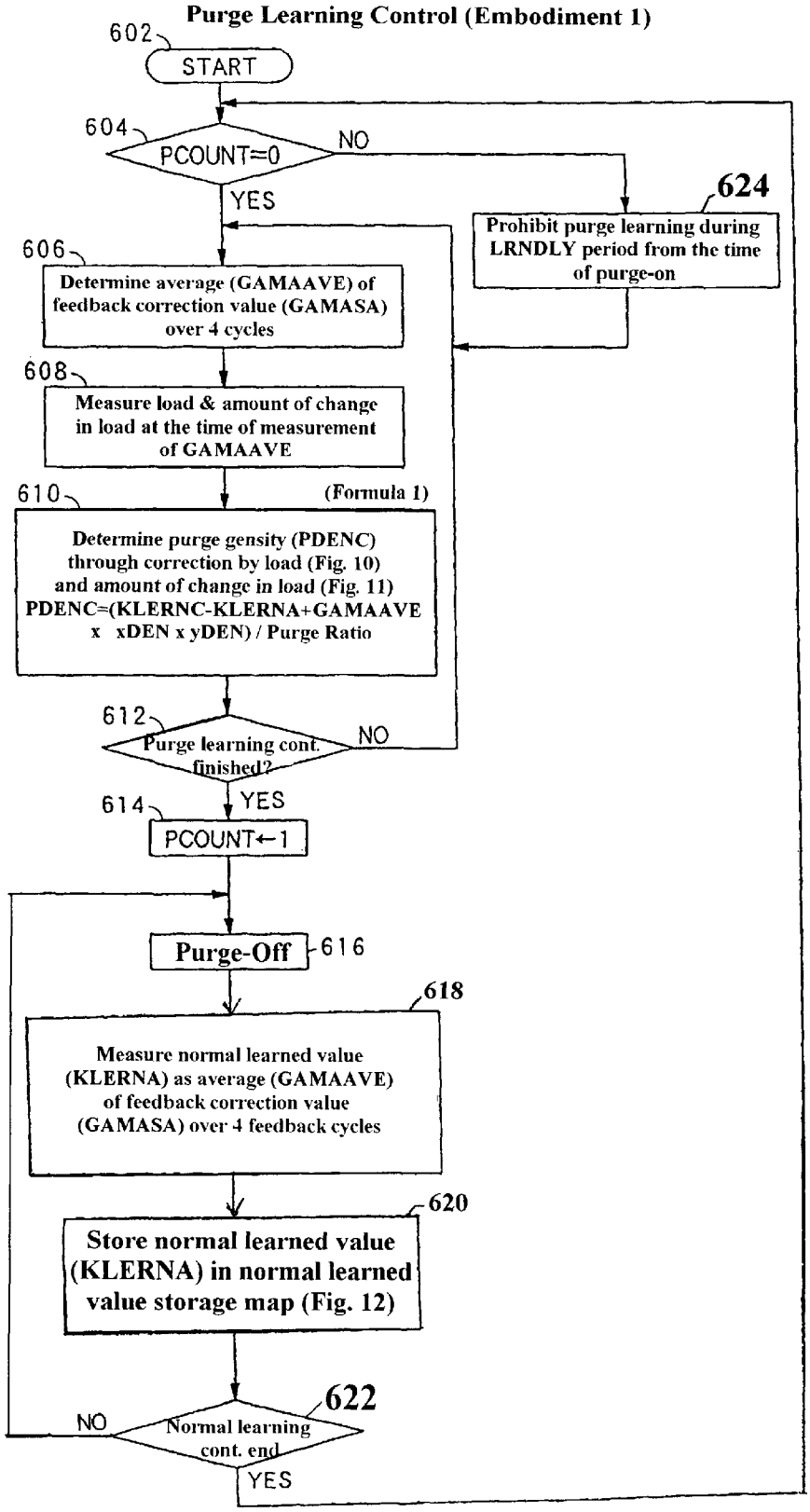
FIG. 6 is a flowchart showing a first example of a purge learning control performed in accordance with the present invention.
Figure 7:
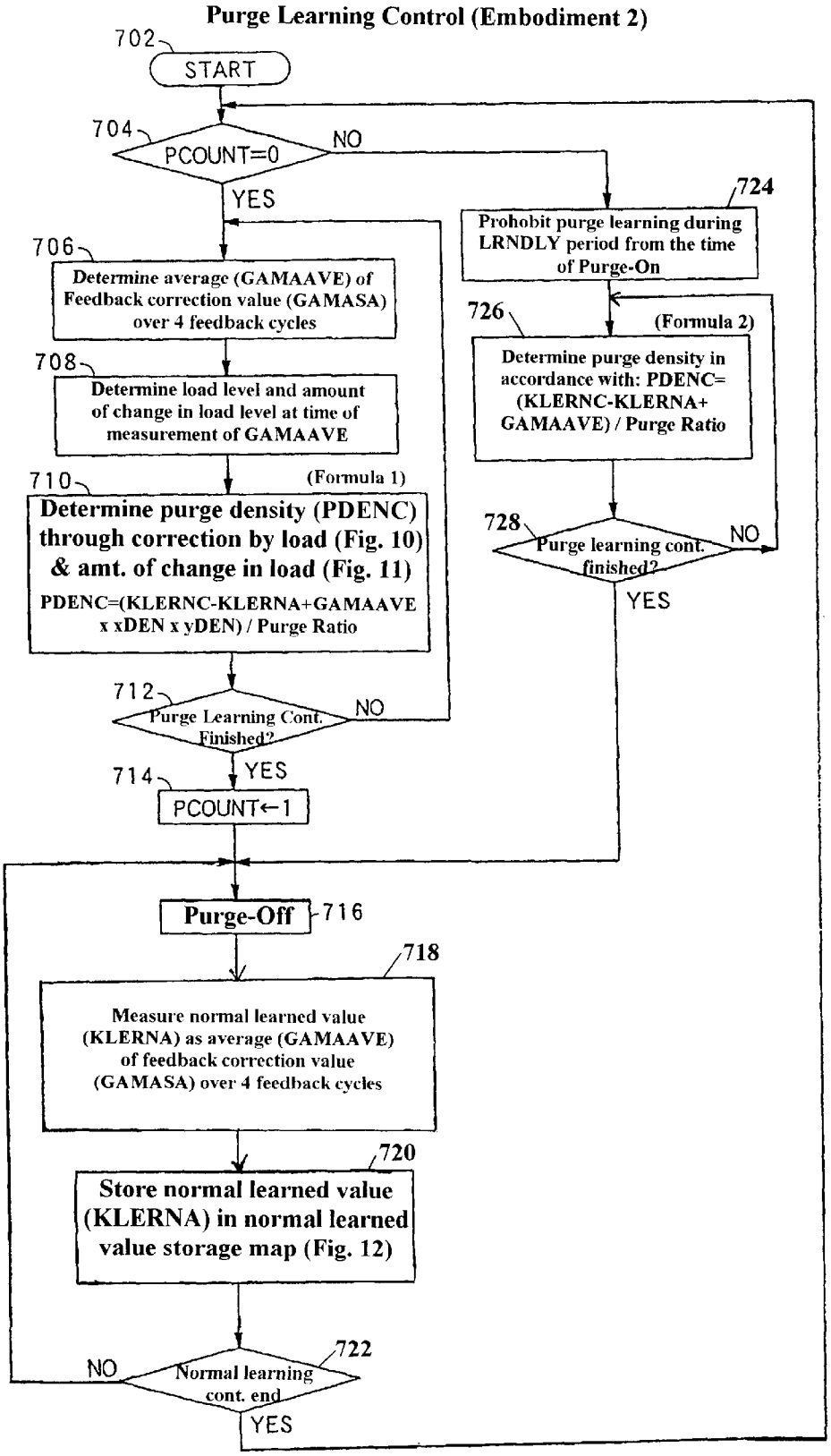
FIG. 7 is a flowchart showing a second example of a purge learning control performed in accordance with the present invention.

More specifically, referring to FIG. 4, a purge ratio (PQA) is newly set based on the purge density (PDENC) that was obtained upon completion of the initial fixed number, i.e., 40 times, of purge learning cycles (Step 402). Then, an operation is performed to read the immediately preceding purge density (PDENC) that was computed in accordance with the formula (1) employed in the first example (Embodiment 1) of the purge learning control as shown in FIG. 6 or in accordance with formula (2) of the second example (Embodiment 2) of the purge learning control as shown in FIG. 7 (Step 404).

Then, the purge ratio (PQA) to be presently achieved by the purge valve 54 is determined based on the immediately preceding purge density (PDENC), in accordance with the diagram shown in FIG. 9.

Subsequently, the immediately preceding purge density (PDENC) read in Step 404 is compared with a reference purge density value (PDLT), so as to determine whether a condition of:

immediately preceding purge density (*PDENC*)≧reference purge density value (*PDLT*) is met (Step 408).

An answer "YES" to the question given in Step 408 indicates that a large quantity of evaporated fuel remains. In this case, the presently set purge ratio (PQA) is compared with a reference purge ratio value (PQDLT), thereby determining whether:

a condition of the purge ratio (*PQA*)≧reference purge ratio value (*PQDLT*) is met (Step 410).

An answer "YES" to the question given in Step 410 indicates that a large quantity of evaporated fuel remains. In this case, the purge valve 54 is controlled so as to gradually increase the opening at a constant rate so that the purge ratio (PQA) progressively and gradually increases towards the target purge ratio (PQA) determined in accordance with the diagram of FIG. 9 (Step 412). This control offers the following advantage. In the first operation of the purge valve control, the purge ratio is set regardless of the purge density. Therefore, when the engine 2 is started with a small purge rate and a small intake air flow rate, high purge density may be maintained. In such a case, the next purge control cycle tends to open the purge valve completely, to achieve a large purge rate corresponding to the high purge density, resulting in impaired drivability. In this embodiment, the purge valve 54 is opened progressively and gradually towards an opening corresponding to the target purge ratio (PQA), rather than being opened at once, whereby the above-described problem is eliminated.

On the other hand, if an answer "NO" is given in response to the question posed in Step 408 or Step 410, the purge ratio as determined in accordance with the diagram of FIG. 9 is set as the target purge ratio (PQA), so that the purge valve 54 is opened at once in accordance with the target purge ratio (PQA), rather than being progressively and gradually opened (Step 414).

After completion of the processing in Step 412 or Step 414, the described routine is executed repeatedly (Step 416).

A description will now be given of the purge control phase 2, with reference to FIG. 5.

As the program is started (Step 502), a determination is conducted as to whether the cooling water temperature has been raised above a predetermined set temperature (PTW) which is, for example, 75° C., i.e., whether the condition of cooling water temperature>PTW is met (Step 504).

If the answer is "YES ", a determination is conducted as to whether the idle switch 98 has been turned off (Step 506).

If the answer to the question posed in Step 506 is "YES", a determination is conducted as to whether the mixture is in an enriched region (Step 508).

When an answer "YES" is obtained in response to the question in Step 508, the purge valve 54 is controlled to open, thereby performing the @purge control, so as to achieve a predetermined first purge ratio, e.g., 2%, a purge ratio which is determined based on the level of the load and the engine speed in accordance with the map shown in FIG. 13, or a purge ratio determined in accordance with the diagram shown in FIG. 14, based on the intake air flow rate as an index of the level of the load on the engine (Step 510).

When an answer "NO" is obtained in response to the question posed in Step 506, or when an answer "NO" is obtained in response to the question posed in Step 508, the purge valve 54 is controlled to open, thereby performing the purge control so as to achieve a purge ratio smaller than the above-mentioned predetermined first purge ratio of 2%, e.g., a purge ratio of 0.5%, a purge ratio which is determined based on the level of the load and the engine speed in accordance with the map shown in FIG. 13, or a purge ratio determined in accordance with the diagram shown in FIG. 14, based on the intake air flow rate as an index of the level of the load on the engine (Step 512).

The described purge control offers the following advantages. Purge control is performed by adjusting the purge rate based on the purge density. Purge rate cannot be definitely determined in a range of engine operation where the air-fuel ratio feedback control and the purge learning control for computing the purge density are not performed. Feedback control is suspended during heavy-load, high-speed running of the engine with an enriched mixture, and so is the purge control.

Much evaporated fuel is accumulated in the fuel tank during long heavy-load operation of the engine as in the case of climbing a long ascending slope. This problem is notable particularly at high altitude where the engine power is reduced to require a greater throttle opening by pressing down the accelerator pedal to a greater degree. Thus, driving at high altitude generally requires the engine to operate with enriched mixture for a long time. This causes a high pressure to be established in the fuel tank because the purging is suspended during such long heavy-load operation of the engine, and poses a risk of escape of the evaporated fuel through a vent hole of the canister. A rapid rise of the fuel tank internal pressure may wrongly lead to warning that a fuel tank internal pressure sensor is malfunctioning, even when the sensor is operating correctly. These problems are overcome by the above-described purge control performed in Step 512.

On the other hand, when "NO" is the answer to the question in Step 504, the process skips to Step 106 of the flow shown in FIG. 1, without performing the control to open the purge valve 54. However, if the routine has proceeded to Step 510 or Step 512, the process advances to Step 106 of the flow shown in FIG. 1, while keeping the purge valve 54 open to a degree corresponding to the purging ratio attained in Step 510 or Step 512.

Figure 2:
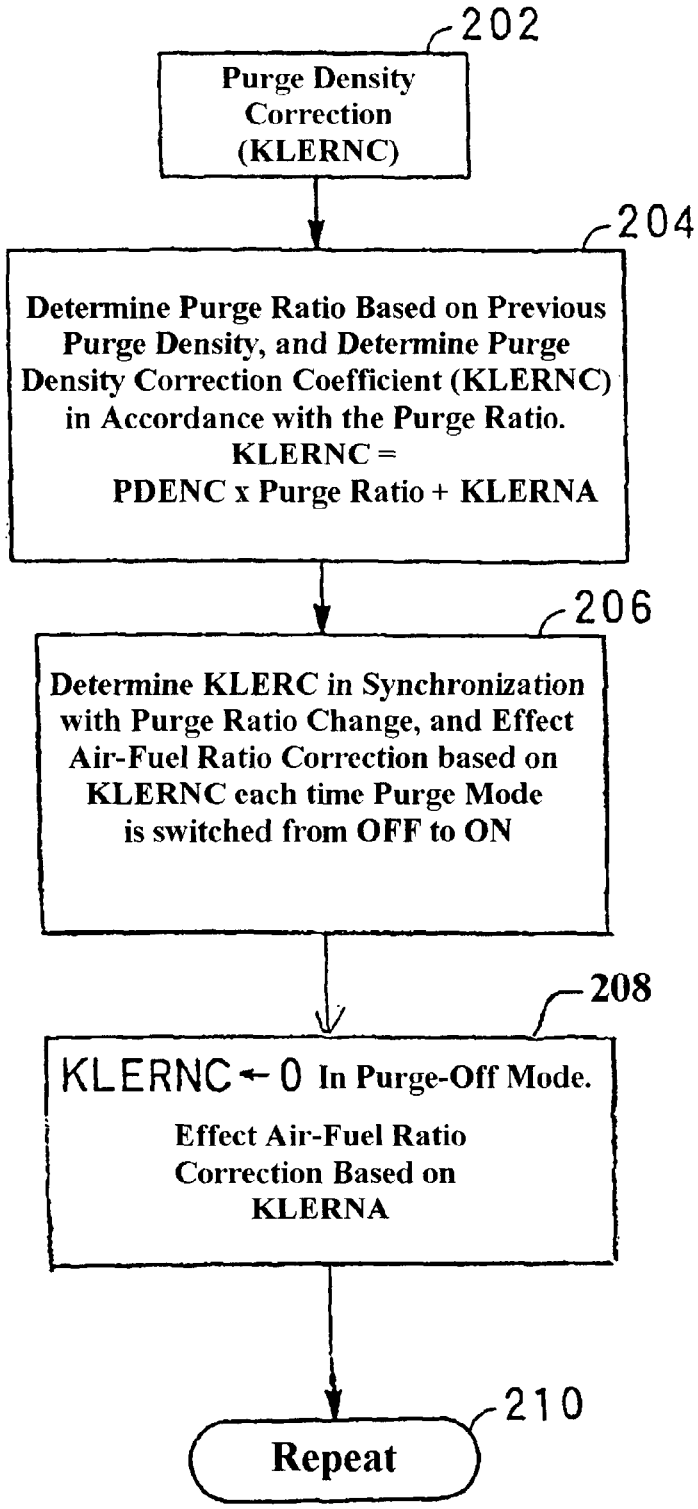
FIG. 2 is a flowchart showing a process for computing a purge learned value, and a process for controlling air-fuel ratio through correction based on a purge learned value and a normal learned value.

A description will now be given of the purge learning control which computes the purge density (PDENC), the purge learned value (KLERNC) and the normal learned value (KLERNA). The present invention may employ either of two types of purge learning control methods, namely:

1) the first example (embodiment 1) shown in FIG. 6 and 2) the second example (embodiment 2) shown in FIG. 7.

The first example (embodiment 1) will be described first with reference to FIG. 6. As the program starts after the start of the engine 2 (Step 602), a determination is made as to whether the content of the purge counter (PCOUNT) is zero, i.e., whether the condition of PCOUNT=0 is met (Step 604).

When the answer to the question posed in Step 604 is "YES", the purge valve 54 is progressively and gradually opened, so that the air-fuel ratio feedback correction value (GAMASA) is controlled to make the air-fuel mixture leaner. Then, the average of the feedback correction value (GAMAAVE) over 4 feedback cycles is determined (Step 606). (see FIG. 16)

Then, the average of the load on the engine during the averaging of the feedback correction value (GAMAAVE) over the 4 feedback cycles, as well as the amount or magnification of the change in the load, is determined (Step 608).

Figure 10:
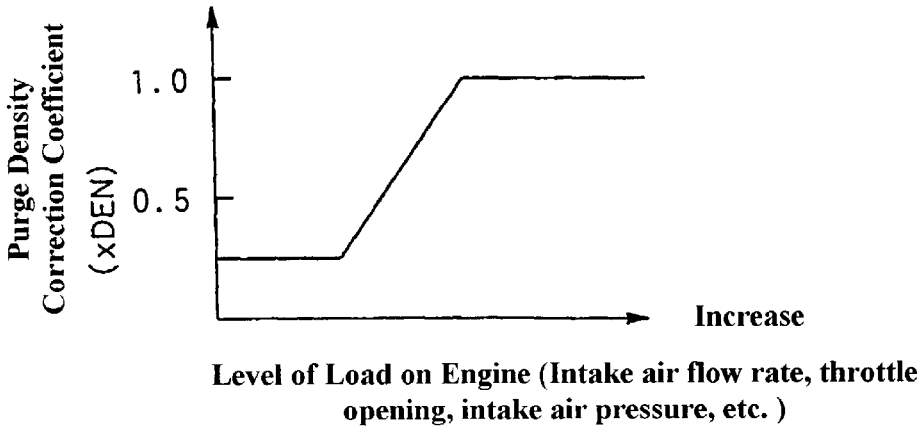
FIG. 10 is a diagram showing the manner in which a purge density correction coefficient is determined based on the level of the load on the engine.
Figure 11:
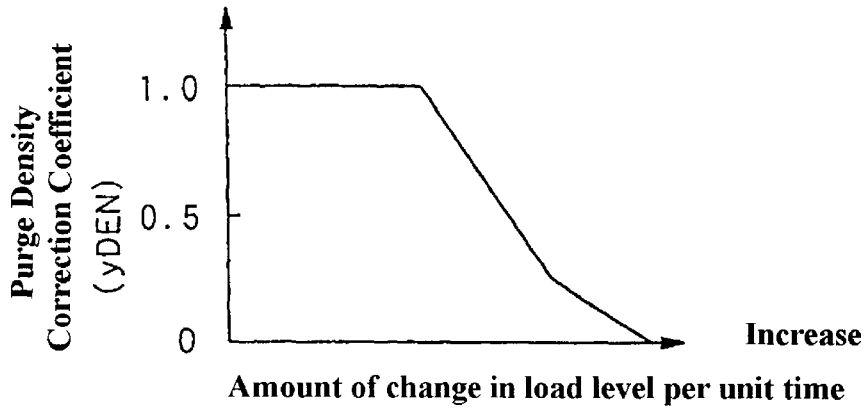
FIG. 11 is a diagram showing the manner in which a purge density correction coefficient is determined based on the rate of change in the load on the engine.

Then, the purge density (PDENC) is determined through corrections conducted in accordance with diagram of FIG. 10 based on the level of the load and in accordance with the diagram of FIG. 11 based on the amount of change in the load per unit time (Step 610).

Thus, the purge density (PDENC) is determined based on the following formula (1):

$$PDENC=(KLERNC-KLERNA+GAMAAVE\times xDEN\times yDEN)+\text{purge ratio} \quad (1)$$

where,

KLERNC: purge learned value learned previously (initially zero upon start-up of the engine)

KLERNA: normal learned value (stored in the storage map shown in FIG. 12)

GAMAAVE: average of the feedback correction value over 4 feedback cycles xDEN: purge density correction coefficient in relation to level of load on the engine (stored as the value on the diagram shown in FIG. 10)

yDEN: purge density correction coefficient in relation to the amount of change in the load level (stored as a value on the diagram shown in FIG. 11)

The purge density (PDENC) as computed in accordance with this formula (1) is stored. The purge learned value is computed based on this purge density (PDENC). The method of computing the purge learned value will be described later with reference to FIG. 2 which shows a flowchart showing a process of air-fuel ratio correction control.

Then, a determination is conducted as to whether a predetermined number of the purge learning cycles has been completed (Step 612). As explained before, the number of purge learning cycles is fixed to, for example, 40 for the first period of purge learning and, for the subsequent periods of purge learning, the number of purge learning cycles is determined based on the purge density (PDENC), as shown in FIG. 8.

When the answer to the question in Step 612 is "NO", the process returns to Step 606 to repeat the purge learning cycles.

When the answer is "YES" to the question in Step 612, the content of the purge counter is incremented by 1, i.e., an operation PCOUNT (1 is performed (Step 614). In this state, at least the initial period of the purge learning control, i.e., the purge learning control performed in the first purge-on mode period, has been finished.

Then, the purge valve 54 is closed to start the purge-off mode (Step 616).

Then, while the purge valve 54 is kept closed, the average value of the air-fuel ratio feedback correction value (G*AMAAVE) is computed over 4 feedback cycles. A normal learning process is performed in which this average value (GAMAAVE) is learned as the normal learned value (KLERNA) (Step 618).

In the meantime, the level of the load on the engine and the engine speed are measured, and the normal learned value (KLERNA) is stored in the normal learned value storage map of FIG. 12 in which square areas are defined according to the level of the load and the engine speed (Step 620).

Then, a determination is conducted as to whether a predetermined number of normal learning cycles in the purge-off mode have been finished (Step 622). This number of normal learning cycles is determined based on the purge density (PDENC), as shown in FIG. 8.

If the answer to the question posed in Step 622 is "NO", the process returns to Step 616 to repeat the normal learning cycles.

In contrast, if the answer is "YES", the process returns to Step 604.

If the answer to the question raised in Step 604 is "NO", the purge learning control is prohibited over a predetermined period of time after the purge valve 54 is controlled to open (Step 624). (see FIG. 16) This predetermined period of time is referred to as a "learning prohibition (LRNDLY)" period. After elapse of the learning prohibition (LRNDLY) period, the process proceeds to Step 606. The learning prohibition (LRNDLY) period is effectively to avoid any undesirable effect which otherwise may be caused by lack of stability in the purge control in the transient period until the evaporated fuel actually reaches the engine 2 after the start of the purge-on mode.

A description will now be given of the second example (embodiment 2) of the purge learning control. Briefly, the second example of the purge learning control is conducted such that the correction in accordance with the diagram of FIGS. 10 and 11 based on the level of the load and the amount of change in the load is executed only for the first period of computation of the purge density (PDENC) following start-up of the engine 2. Namely, the correction based on the level of the load and the amount of change in the load is omitted for the second and subsequent periods of computation of the purge density (PDENC).

More specifically, as the program is commenced (Step 702) after the engine 2 is started, a determination is conducted as to whether the content of the purge counter (PCOUNT) is zero, i.e., whether the condition PCOUNT=0 is met (Step 704).

When the answer to the question raised in Step 704 is "YES", the purge valve 54 is progressively and gradually opened, so that the air-fuel ratio feedback correction value (GAMASA) is controlled to make the air-fuel mixture leaner. Then, the average value (GAMAAVE) of the feedback correction value over the four feedback cycles is determined (Step 706). (see FIG. 16)

Then, the average level of the load on the engine, as well as the amount of change in the load level, in the period of measurement of the average feedback correction value (GAMAAVE) over 4 feedback cycles is determined (Step 708).

Then, the purge density (PDENC) is determined through correction processing which are performed based on the load level on the engine and the amount of change in the load level, in accordance with the diagrams shown in FIGS. 10 and 11 (Step 710).

More specifically, the purge density (PDENC) is determined in accordance with the following formula (1):

$$PDENC=(KLERNC-KLERNA+GAMAAVE\times xDEN\times yDEN)+\text{purge ratio} \quad (1)$$

where,

KLERNC: purge learned value learned in the immediately preceding purge-on mode (initially zero upon start-up of the engine)

KLERNA: normal learned value (stored in the storage map shown in FIG. 12)

GAMAAVE: average of the feedback correction value over 4 feedback cycles xDEN: purge density correction coefficient in relation to level of load on the engine (stored as the value on the diagram shown in FIG. 10)

yDEN: purge density correction coefficient in relation to the amount of change in the load level (stored as a value on the diagram shown in FIG. 11)

The purge density (PDENC) as computed in accordance with this formula (2) is stored, and the purge learned value is computed based on this purge density (PDENC). The method of computing the purge learned value will be described later with reference to FIG. 2 which shows a flowchart showing a process of air-fuel ratio correction control.

Then, a determination is conducted as to whether a predetermined number of purge learning cycles has been completed (Step 712). As explained before, the number of purge learning cycles is fixed to, for example, 40 for the first period of purge learning and, for the subsequent periods of purge learning, the number of purge learning cycles is determined based on the purge density (PDENC), as shown in FIG. 8.

When the answer to the question in Step 712 is "NO", the process returns to Step 706 to repeat the purge learning cycles.

When the answer is "YES" to the question in Step 712, the content of the purge counter is incremented by 1, i.e., an operation PCOUNT (1 is performed (Step 714). In this state, at least the initial period of the purge learning control, i.e., the purge learning control performed in the first purge-on mode period, has been finished.

Then, the purge valve 54 is closed to start the purge-off mode (Step 716).

Then, while the purge valve 54 is kept closed, the average value of the air-fuel ratio feedback correction value (GAMAAVE) is computed over 4 feedback cycles, and a normal learning process is performed in which this average value (GAMAAVE) is learned as the normal learned value (KLERNA) (Step 718).

In the meantime, the level of the load on the engine and the engine speed are measured, and the normal learned value (KLERNA) is stored in the normal learned value storage map of FIG. 12 in which square areas are defined according to the level of the load and the engine speed (Step 720).

Then, a determination is conducted as to whether a predetermined number of normal learning cycles in the purge-off mode has been finished (Step 722). This number of normal learning cycles is determined based on the purge density (PDENC), as shown in FIG. 8.

If the answer to the question posed in Step 622 is "NO", the process returns to Step 716 to repeat the normal learning cycles.

In contrast, if the answer is "YES", the process returns to Step 704.

If the answer to the question raised in Step 704 is "NO", purge learning control is prohibited over a predetermined period of time after the purge valve 54 is controlled to open (Step 724). (see FIG. 16)

Then, the purge density (PDENC) is determined in accordance with the following formula (2) (Step 726):

$$PDENC=(KLERNC-KLERNA+GAMAAVE)+\text{purge ratio} \quad (2)$$

Then, a determination is made as to whether the predetermined number of purge learning cycles as determined in accordance with the diagram of FIG. 8 has been completed (Step 728).

If the answer to the question in Step 728 is "YES", the process advances to Step 716.

If the answer is "NO", the process returns to Step 726.

A description will now be given of the computation of the purge learned value and the air-fuel ratio correction control executed based on the purge learned value. In the purge-on mode, the purge learned value (KLERNC) is computed by a program as shown in FIG. 2, and the air-fuel ratio correction control is performed by using the computed purge learned value (KLERNC).

Referring to FIG. 2, as the program for computing the purge learned value (KLERNC) is started (Step 202), at the time of switching from purge-off mode to purge-on mode, the purge ratio (PQA) is determined based on the purge density (PDENC) obtained in the immediately preceding period of purge density computation, in accordance with the diagram shown in FIG. 9. At the same time, the normal learned value (KLERNA) that was computed in the purge-off mode and stored in the normal learned value storage map of FIG. 12 is read from this map. Then, the purge learned value (KLERNC) is determined in accordance with the following formula (3) (Step 204):

$$\text{purge learned value } (KLERNC)=\text{purge density } (PDENC)\times\text{purge ratio } (PQA)+\text{normal learned value } (KLERNA) \quad (3)$$

Then, the purge learned value (KLERNC) to be used for the present correction is determined in synchronization with the change in the purge ratio (PQA). Thus, the purge learned value (KLERNC) is determined each time the switching is performed from the purge-off mode to the purge-on mode and each time the purge ratio (PQA) is changed in the purge-on mode, and the air-fuel ratio is corrected based on such purge learned value (KLERNC) each time the purge learned value (KLERNC) is determined.

In the purge-off mode, the purge learned value (KLERNC) is set to zero, i.e., an operation of KLERNC (0 is performed and the correction of the air-fuel ratio is executed based on the normal learned value (KLERNA) read from the normal learned value storage map of FIG. 12 (Step 208).

Then, the above-described computation and the correction of the air-fuel ratio are repeated (Step 210).

Thus, the purge valve is controlled in accordance with the purge control phase 2 of FIG. 5, when the fuel feedback control is suspended or when the fuel learning control is suspended, as shown in FIG. 1. This suppresses the risk of leakage of the evaporated fuel out of the fuel tank 32, because the internal pressure of the fuel tank 32 is not raised despite a large amount of pressing down of the accelerator pedal during, for example, running along an ascending slope or driving at a high altitude, by virtue of the purge control phase 2 of FIG. 5. This also prevents any wrong diagnosis of the tank internal pressure performed by the tank pressure sensor 44.

In the purge control phase 1 of the purge valve control shown in FIG. 3, the number of the purge learning cycles and the number of the normal learning cycles are set based on the purge density (PDENC), as shown in FIG. 8. For instance, when a large amount of evaporated fuel is trapped in the canister 42, the control is performed to increase the purge rate, which in turn serves to increase the amount of change in the purge density (PDENC). Consequently, the frequency of the purge learning cycles and, hence, the frequency of purge density computation are increases, thus achieving a higher resolution of computation of the purge density (PDENC). The air-fuel ratio is controlled by the purge density which is determined at the high resolution, whereby the drivability is improved and increase of the exhaust emissions is avoided.

In this embodiment, the purge ratio (PQA) is set in accordance with the purge density (PDENC), in the manner shown in FIG. 9. Therefore, when the purge density (PDENC) is high, the purge rate is limited so as to suppress introduction of the evaporated fuel, thereby preventing increase in the exhaust emissions, whereas, when the purge density (PDENC) is low, the purge rate is also reduced to suppress introduction of air from the purge valve into the combustion chamber, thereby preventing deterioration of the feedback control, thus avoiding increase in the rate of discharge of exhaust emissions.

The quantity of the evaporated fuel in the canister 42 is not known in the state immediately after start-up of the engine. In the described embodiment of the present invention, the number of the purge learning cycles is fixed to a certain value, only in the first period of the purge learning control. Thus, the purge learning cycles are performed without fail in the first period of the purge learning control.

In the described embodiment, the purge ratio (PQA) is set in accordance with the purge density (PDENC), as shown in FIG. 9. When the purge ratio (PQA) and the amount of correction of fuel supply are controlled by changing the purge density, a large amount of change in the purge density (PDENC) may impair the accuracy of the fuel control, resulting in an increase in the rate of discharge of exhaust emissions and deterioration of drivability. In order to obviate this problem, in the described embodiment of the present invention, the purge valve 54 is progressively and gradually opened toward the target purge ratio (PQA), when the amounts of change in the purge density (PDENC) and change in the purge rate (PQA) are large.

Further, in the purge control phase 2 of the purge valve control shown in FIG. 5, the purge ratio (PQA) during engine operation in the enriched region is controlled differently from the purge ratio during engine operation with the idle switch 98 turned on or in the region other than the enriched region. During the engine operation in the enriched region, the actual purge rate decreases as shown in FIG. 5, because the intake vacuum approaches the atmospheric pressure, although the flow rate of the intake air is large. Therefore, the purge ratio (PQA) produces less influence on the fuel control, even if the purge ratio is set to be greater than that in the light-load operation of the engine. It is therefore possible to effect the purge control with the fixed value as determined in accordance with the diagrams of FIGS. 13 and 14, thus achieving excellent purge control.

The purge density (PDENC) is determined in accordance with the first or second example of the purge learning control as shown in FIG. 6 or 7. The determination of the purge density (PDENC) may be performed such that, as shown in FIG. 10, the purge density correction coefficient is controlled so as to be reduced in the region of lighter load. Such a control effectively prevents the exhaust emissions from increasing, while achieving better drivability.

In accordance with the diagram shown in FIG. 11, the purge density correction coefficient is controlled so as to decrease when the level of the load on the engine is varied largely. In the first example of the purge learning control as shown in FIG. 6, the purge density correction coefficient is controlled to decrease always during the purge learning operation. In the second example of the purge learning control shown in FIG. 2, the purge density correction coefficient is controlled so as to be decreased, only in the first period of purge learning control which immediately follows the start-up of the engine. These controls are effective in suppressing any tendency for the exhaust emissions to increase, and in improving the drivability.

It is therefore possible to accurately determine the purge density (PDENC) with high resolution, so that the purge valve control and the air-fuel ratio control are performed with high accuracy, thus preventing deterioration of the drivability and stabilizing the rate of discharge of exhaust emissions.

Further, since the number of the learning cycles is changed in accordance with a variation in the purge density (PDENC), it is possible to optimally control the purge rate and the air-fuel ratio regardless of the ambient conditions and driving conditions.

It is also possible to effectively suppress the risk of leakage of the evaporated fuel, even during driving at high altitude.

Further, since the purge rate is controlled in accordance with the purge density (PDENC), it is possible to avoid excessive purging, thus preventing deterioration of drivability and stabilizing he rate of discharge of exhaust emissions.

Furthermore, rising tendency of the pressure inside the fuel tank is suppressed even during operation of the engine in enriched region of the mixture, with the accelerator pedal largely footed down as in the case of driving along an ascending slope. Consequently, the risk of leakage of the evaporated fuel is avoided, and erroneous diagnosis on the tank pressure sensor 44 is avoided.

In the described embodiment, the purge learning control is always executed whenever the engine is operating in the purge-on mode. This, however, is not essential and the arrangement may be such that the purge learning control is intentionally suspended when the state of engine operation does not specifically require such a control, so as to reduce the burden on the control unit in terms of the operation time and computation load.

As will be understood from the foregoing description, the purge control system of the present invention has the controlling means for setting the number of the purge learning cycles and the number of the normal learning cycles, so as to vary the frequency of the purge learning cycles, based on the state of the computed purge density.

The preferred embodiment of the invention has the following features.

The controlling means fixes the number of the purge learning cycles to a predetermined value only in the first period of purge learning control which immediately follows start-up of the engine, and learn the results of the purge density computations until the total number of the purge learning cycles reaches the predetermined value.

The controlling means also sets, based on the purge density, a purge ratio which is the ratio of the purge rate to the flow rate of the intake air introduced into the engine.

The arrangement is such that the controlling means determines, during light-load operation of the engine, a purge density correction coefficient based on the level of the load on the engine, and effects a correction of the computed purge density by using the purge density correction coefficient.

Alternatively, the arrangement is such that the controlling means determines, when the level of the load on the engine is being changed, a purge density correction coefficient based on the amount of the change in the level of the load on the engine, and effects a correction of the computed purge density by using the purge density correction coefficient.

When the purge density correction coefficient is used, the controlling means may effect the correction of the computed purge density by using the purge density correction coefficient only in the first period of purge learning control which immediately follows start-up of the engine.

The arrangement is such that, when the amount of change in the purge density is greater than a purge density variation reference value while the amount of change in the purge ratio is greater than a purge ratio variation reference value, the controlling means increases the purge ratio to a target purge ratio progressively in a plurality of steps with a constant increment, whereas, when the amount of change in the purge density is smaller than the purge density variation reference value while the amount of change in the purge ratio is smaller than the purge ratio variation reference value, the controlling means controls the purge valve to open so as to increase the purge ratio to the target purge ratio in a non-stepped manner.

The arrangement also is such that, when the feedback control of the air-fuel ratio has been suspended with the air-fuel mixture held in an enriched region, the controlling means performs the purge control by opening the purge valve, so as to achieve a constant purge ratio, a purge ratio determined based on the engine speed and the level of the load on the engine, or a purge ratio determined based on the level of the load on the engine.

The arrangement also is such that, when an idle switch has been turned on and/or when the air-fuel ratio feedback control has been suspended with the air-fuel ratio falling out of the enriched region, the controlling means performs the purge control by opening the purge valve, so as to achieve a constant purge ratio, a purge ratio determined based on the engine speed and the level of the load on the engine, or a purge ratio determined based on the level of the load on the engine.

By virtue of these features, according to the present invention, the frequency of the purge density learning cycles is changed based on the state of the computed purge density. For instance, when a large quantity of evaporated fuel remains on the canister, the purge rate and, hence, the amount of change in the purge density are increased. In this case, the frequency of the purge learning cycles is increased to employ a greater number of purge learning cycles per unit time, thus achieving a high resolution and accuracy of purge density computation. Consequently, the air-fuel ratio is controlled based on the purge density that has been computed with high resolution and accuracy, whereby the drivability is improved and the rate of discharge of exhaust emissions is stabilized. Further, leakage of the evaporated fuel is avoided during, for example, long driving along an ascending slope. Further, mis-diagnosis on the tank pressure sensor is also avoided.

Although the invention has been described in its preferred form, it is to be understood that the described embodiment is only illustrative, and various changes and modifications may be imparted thereto without departing from the scope of the present invention which is limited solely by the appended claims.

What is claimed is:

1. A purge control system for an engine; comprising;

an evaporated fuel passage leading from the interior of a fuel tank;

a canister receiving an output of said evaporated fuel passage;

a purge passage receiving an output of said canister;

said purge passage leading to an intake system of said engine;

said canister including means for sorbing and holding evaporated fuel coming from said fuel tank and for allowing evaporated fuel to be purged therefrom by introduction of air, so that the air and the evaporated fuel in combination form a purge gas to be supplied to said engine;

a purge valve disposed in said purge passage;

means for opening and closing said purge valve in accordance with a state of operation of said engine so as to establish a purge-on mode and a purge-off mode, thereby controlling a purge rate which is the flow rate of the purge gas supplied to said engine;

an air-fuel ratio sensor disposed in an exhaust system of said engine;

an air-fuel ratio feedback controller for performing a feedback control of the air-fuel ratio based on an output signal from said air-fuel ratio sensor and a purge density which is computed as a concentration of evaporated fuel in said purge gas supplied to said engine;

air-fuel ratio correcting means for performing, in said purge-on mode, a purge learning control;

said purge learning control having a plurality of cycles for learning the results of computations of the purge density and for effecting correction of the air-fuel ratio based on purge learned values obtained through the learning;

said air-fuel ratio correction means performing, in said purge-off mode, a normal learning control having a plurality of normal learning cycles to obtain normal learned values and effecting correction of the air-fuel ratio based on normal learned values; and controlling means for setting the number of the purge learning cycles and the number of the normal learning cycles, so as to vary the frequency of the purge learning cycles, based on the state of the computed purge density, wherein, when an amount of change in said purge density is greater than a purge density variation reference value while an amount of change in said purge ratio is greater than a purge ratio variation reference value, said controlling means increases said purge ratio to a target purge ratio progressively in a plurality of steps with a constant increment, whereas, when the amount of change in said purge density is smaller than said purge density variation reference value while the amount of change in the purge ratio is smaller than said purge ratio variation reference value, said controlling means controls said purge valve to open so as to increase said purge ratio to said target purge ratio in a non-stepped manner.

2. A purge system of an engine according to claims 1, wherein said controlling means fixes the number of the purge learning cycles to a predetermined value only in the first period of purge learning control which immediately follows start-up of said engine, and learns the results of the purge density computations until the total number of the purge learning cycles reaches said predetermined value.

3. A purge system of an engine according to claim 1, wherein said controlling means sets, based on said purge density, a purge ratio which is the ratio of said purge rate to the flow rate of the intake air introduced into said engine.

4. A purge control system of an engine according to claim 1, wherein said controlling means determines, during light-load operation of said engine, a purge density correction coefficient based on a level of the load on said engine, and effects a correction of computed purge density using said purge density correction coefficient.

5. A purge control system of an engine according to claim 1, wherein said controlling means determines, when a load on said engine is being changed, a purge density correction coefficient based on an amount of the change in the load on said engine, and effects a correction of said computed purge density using said purge density correction coefficient.

6. A purge control system of an engine according to claim 4, wherein said controlling means effects correction of computed purge density using said purge density correction coefficient only in a first period of purge learning control which immediately follows start-up of said engine.

7. A purge control system of an engine according to claim 5, wherein said controlling means effects correction of computed purge density using said purge density correction coefficient only in a first period of purge learning control which immediately follows start-up of said engine.

8. A purge system of an engine according to claim 1, wherein, when feedback control of said air-fuel ratio has been suspended with said air-fuel mixture held in an enriched region, said controlling means performs said purge control by opening said purge valve, an amount effective to achieve one of: a constant purge ratio, a purge ratio determined based on engine speed and level of load on said engine, and a purge ratio determined based on said level of load on said engine.

9. A purge system of an engine according to claim 1, further comprising:

an idle switch;

when at least one of said idle switch is turned on and when said air-fuel ratio feedback control has been suspended with said air-fuel ratio falling out of an enriched region, said controlling means performs purge control by opening said purge valve to achieve at least one of the following:

a) a constant purge ratio, b) a purge ratio determined based on engine speed and level of load on said engine, and c) a purge ratio determined based on level of load on said engine.

* * * * *